United States Patent [19]

Reimer

[11] Patent Number: 4,888,671

[45] Date of Patent: Dec. 19, 1989

[54] ORNAMENTAL STRIP LIGHT MOUNTING MEANS

[76] Inventor: Peter Reimer, P.O. Box 571, Shafter, Calif. 93263

[21] Appl. No.: 290,801

[22] Filed: Dec. 27, 1988

Related U.S. Application Data

[63] Continuation-in-part of Ser. No. 167,781, Mar. 14, 1988, abandoned.

[51] Int. Cl.[4] ..... F21Y 21/34

[52] U.S. Cl. ..... 362/250; 362/429; 362/806

[58] Field of Search ..... 362/250, 252, 151, 152, 362/418, 429, 806, 249

[56] References Cited

U.S. PATENT DOCUMENTS

| | | | |
|---|---|---|---|
| 3,204,090 | 8/1965 | Kvarda, Jr. | 362/249 |
| 3,596,859 | 8/1971 | MacDonald | 248/214 |
| 4,173,035 | 10/1979 | Hoyt | 362/252 |
| 4,244,014 | 1/1981 | Van Ess | 362/249 |
| 4,335,422 | 6/1982 | Van Ess | 362/388 |
| 4,357,653 | 11/1982 | Kovacs | 362/250 X |
| 4,404,621 | 9/1983 | Mauro | 362/250 |
| 4,439,818 | 3/1984 | Scheib | 362/250 |
| 4,471,415 | 9/1984 | Larson et al. | 362/250 |
| 4,555,749 | 11/1985 | Rifkin et al. | 362/800 |
| 4,577,264 | 3/1986 | Plumly | 362/252 |
| 4,731,710 | 3/1988 | Distasio | 362/250 X |

*Primary Examiner*—Stephen F. Husar
*Assistant Examiner*—Richard R. Cole
*Attorney, Agent, or Firm*—Frank J. Dykas; Craig M. Korfanta

[57] ABSTRACT

Ornamental light mounting strip 10 having an elongated resilient base 11 and removably attached light socket holders 13. Light socket holders 13 have a first receiving channel 14 for receiving a typical light bulb and socket 17 and a second receiving channel 18 for receiving rib 12 attached to the elongated resilient base 11. The previously described second receiving channel 18 and rib 12 provide for adjustable attachment of the light socket holder 13 to the elongated base 11.

9 Claims, 3 Drawing Sheets

ORNAMENTAL STRIP LIGHT MOUNTING MEANS

This is a continuation in part of application Ser. No. 07/167,781, filed on 03/14/88 now abandoned.

BACKGROUND OF THE INVENTION

1. Technical Field.

This invention relates to systems for mounting and displaying strings of ornamental Christmas lights and more particularly means for mounting such light strings on the exterior of a house or other structure.

2. Background Art.

Prior art discloses other means for mounting light strings such as Christmas lights to the exterior of structures. U.S. Pat. No. 3,204,090, discloses a perforated elongated U-shaped channel for mounting Christmas lights to a rain gutter. It discloses a means by which the ornamental Christmas lights are inserted through the back or inside of the channel utilizing spaced holes along the axis of the channel.

U.S. Pat. No. 3,596,859 teaches a clip for attaching decorative lights to eaves troughs which hooks over the front edge of the eaves troughs. The clip jaws are made of a resilient material and receive and hold the light bulb sockets.

U.S. Pat. No. 4,244,014, discloses an extruded base tape having buttons or knobs which cooperate with an elastic restraining strip to grip individual light sockets in a string of lights.

U.S. Pat. No. 4,335,422, discloses an elastic ribbon disposed in a stretched configuration cooperating with a flexible ribbon to form pockets to receive and tightly clasp individual light sockets in a string of lights. Various means are disclosed to form the individual light socket retaining loops.

The principal shortcoming with the prior art is that it is not at the same time susceptible of unitary construction and capable of being mounted on any rigid surface or between any two such surfaces. While U.S. Pat. No. 3,596,859 shows resilient jaws for receiving and holding a light bulb socket, it is not adaptable for use on structures not having an eaves trough or rain gutter.

Not shown in any of the prior art is a device which is adaptable for use with strings of lights having differing spacing between each light socket. A second, and very significant and practical problem not solved by the prior art, is that the mounting strip must be flexible enough to conform to and easily bend around the structure to which it is affixed, yet the light socket clamps must be rigid enough to securely hold the light socket in place.

It is an object of this invention to provide means for removably displaying string lighting, such as ornamental Christmas lighting, on the exterior of houses or other buildings with a flexible elongated base strip and a plurality of adjustable light socket holders which can be attached to the base strip at spaced intervals conforming to the spacing of the light sockets for the particular string lighting assembly being used. A second object is to provide individual attachable light socket holders which are fabricated of more rigid material in order to facilitate secure holding of individual light sockets.

DISCLOSURE OF INVENTION

These objects are accomplished by a light mounting strip having an elongated base strip which is easily attachable to most structures and light socket holders which are individually attachable to the elongated base. The elongated base strip is constructed from a resilient and highly flexible material and has at least one rib running longitudinally along its entire length. The light socket holders have a transverse receiving channel for engaging the rib on the flexible strip. The light socket holders also have another receiving channel disposed longitudinally for receiving the light sockets and light bulbs of a typical ornamental Christmas light string.

It is anticipated that the mounting strip will be made of plastic and consequently be inexpensively and easily manufactured. The mounting strip is particularly suited to permanent installation outdoors while at the same time permitting the seasonal installation or removal of the ornamental Christmas light strings. The invention thus provides all-weather permanent means for displaying ornamental lights while allowing the light strings themselves to be protected from the weather by removal and indoor storage during the non-use.

The individual base strip or strips may be readily cut to length to facilitate installation. Additionally, being made of resilient material the strips are well suited to installation to any flat or curved surface. At the same time, the strips have sufficient rigidity to be somewhat self-supporting as where installed with one end fastened to a window frame and the other to a facia board at the eaves.

BEST MODE FOR CARRYING OUT INVENTION

Figure 1:
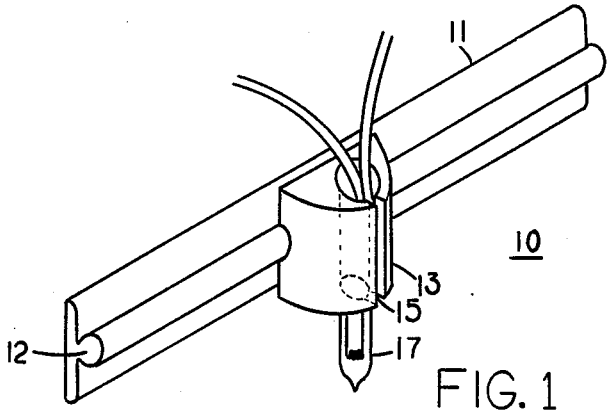
FIG. 1 is a representational view of a first embodiment of the base strip and light socket holder holding an ornamental light.
Figure 2:
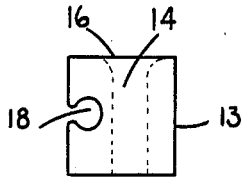
FIG. 2 is a side view of a first embodiment of a light socket holder.

Referring to FIGS. 1 and 2, a first preferred embodiment for mounting and displaying strings of ornamental Christmas lights is shown and generally designated as 10. For the purposes of this disclosure, a Christmas light string constitutes a plurality of light bulbs contained in light sockets which are electrically and structurally connected one to the other by a pair of wires having a standard plug at one end for engaging a standard electrical wall socket. An elongated base strip 11, is fabricated from a strip of flexible plastic, and has a rib 12 formed along its entire length.

A light socket holder 13 has longitudinal channel 14, also referred to as a cylindrical channel, for retaining ornamental light bulb and socket 17. The longitudinal channel 14 has a separating slot 15 disposed along its side and parallel to the cylindrical channel axis to provide a clasp for resilient frictional engagement with ornamental light bulb and socket 17. The light socket holder 13 has a flared opening 16 which facilitates insertion of the ornamental light bulb and socket 17.

A means for attaching the light socket holder 13 to the mounting strip 11 is provided by rib 12 and a second transverse channel 18 formed integrally with light socket holder 13.

Figure 3:
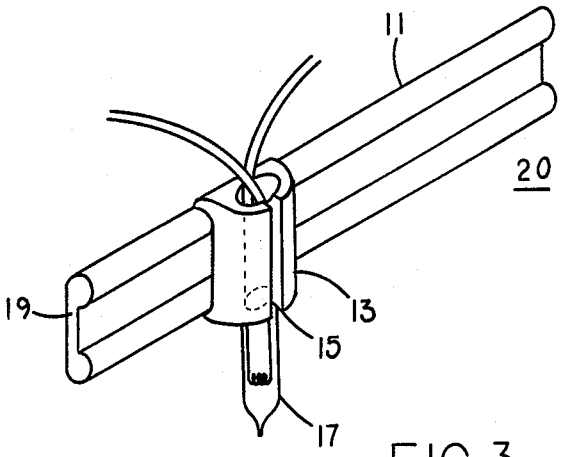
FIG. 3 is a representational view of a second ornamental light socket holder assembly.
Figure 4:
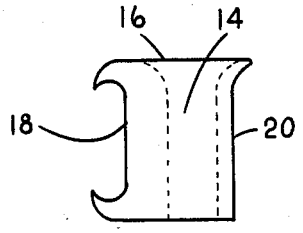
FIG. 4 is a side view of the second embodiment of the light socket holder.
Figure 5:
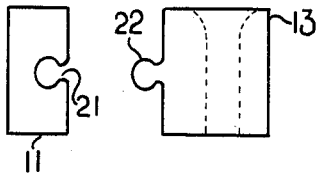

Referring now to FIGS. 3 and 4, a second embodiment is shown and designated as 20, wherein the primary difference is the addition of dual ribs 19. Here ribs 19 are again formed integrally along the entire length of mounting strip 11 but are located at its outer edges. In this second embodiment, the cylindrical channel 14, separating slot 15, and flared opening 16, all of the light socket holder 20 are essentially identical to the first embodiment.

Referring specifically to FIG. 4, it is shown that the difference between light socket holders 13 and 20 of the two embodiments, occurs in the widening of the second receiving channel 18 from its original width in the first embodiment. This allows for slidable engagement of the light socket holder 13 with the two ribs 12, located on the mounting strip 11.

One of the unique advantages of using these preferred embodiments is that base strips 12 and 19 can be fabricated from a flexible material which can easily be conformed to any shape desired. Additionally these flexible strips can be fabricated from material which is transparent or colored material so that they will match the color of the underlying structure to which they are mounted, thus eliminating the need to remove and periodically reinstall the mounting strips.

A second improvement which results from the use of these embodiments of my new invention, is that the light socket holders 13 and 20 can be made of a different material than the flexible base strips 12 and 19. If light socket holders 13 and 20 were to be formed integral with the base strips 12 and 19, then they would necessarily be formed of the same material which, in practice, has been found unsuitable in that either the base strip or the socket holders will be too rigid or flexible as the case may be. A permanent attachment of light socket holders 13 and 20, if they are made of different materials from the base strips 12 and 19, is difficult and expensive to accomplish and, of course, defeats one of the primary purposes of this invention, which is to allow adaptation of the mounting strip assembly to ornamental light strings having differing lengths between light sockets.

It should be apparent to anyone skilled in the art that there are a variety of different attachment means which are easily adapted for use with my new invention. Some of which would include adaptation of the light sockets of the ornamental light strips themselves for attachment to the base strip, and secondly, that a variet of different rib slot and hole and pin configurations can be use in lieu of the ribs of the preferred embodiments.

While there is shown and described the present preferred embodiment of the invention, it is to be distinctly understood that this invention is not limited thereto but may be variously embodied to practice within the scope of the following claims.

I claim:

1. An ornamental light string mounting means which comprises:

an elongated base strip of flexible and resilient material having a longitudinal rib means formed integrally therewith for attachment to a structure;

a plurality of light socket holders having first receiving channels longitudinally disposed therein, for receiving a light socket;

said socket holders having a second receiving channel transversely disposed therein for receiving and frictional attachment with the longitudinal rib means of the elongated base strip, whereby each of said light socket holders may be independently and adjustably held in a fixed position along the elongated base strip.

2. The ornamental light string mounting means of claim No. 1 wherein said elongated base strip is fabricated of transparent material.

3. The ornamental light string mounting means of claim No. 1 wherein said elongated base strip is fabricated of opaque, colored material.

4. An ornamental light string mounting means which comprises:

an elongated base strip of flexible and resilient material having a plurality of ribs formed integrally therewith for attachment to a structure;

a plurality of light socket holders having first receiving channels longitudinally disposed therein, for receiving a light socket;

said socket holders having a plurality of receiving channels transversely disposed therein for receiving and frictional attachment with the plurality of ribs of the elongated base strip, whereby each of the said light socket holders may be independently and adjustably held in a fixed position along the elongated base strip.

5. The ornamental light string mounting means of claim No. 4 wherein said elongated base strip is fabricated of transparent material.

6. The ornamental light string mounting means of claim No. 4 wherein said elongated base strip is fabricated of opaque, colored material.

7. An ornamental light string mounting means which comprises:

an elongated base strip of flexible and resilient material having a slot means formed integrally therewith for attachment to a structure;

a plurality of light socket holders having first receiving channels longitudinally disposed therein, for receiving a light socket;

said socket holders having an attachment means for insertion into and frictional attachment with the slot means of the elongated base strip, whereby each of said light socket holders may be independently and adjustably held in a fixed position along the elongated base strip.

8. The ornamental light string mounting means of claim No. 7 wherein said elongated base strip is fabricated of transparent material.

9. The ornamental light string mounting means of claim No. 7 wherein said elongated base strip is fabricated of opaque, colored material.

* * * * *